United States Patent [19]

Bergner

[11] Patent Number: 4,854,482

[45] Date of Patent: Aug. 8, 1989

[54] DISPENSING DEVICE FOR FLOWABLE MASSES

[75] Inventor: Arndt Bergner, Munich, Fed. Rep. of Germany

[73] Assignee: Hilti Aktiengesellschaft, Fürstentum, Liechtenstein

[21] Appl. No.: 159,325

[22] Filed: Feb. 23, 1988

[30] Foreign Application Priority Data

Feb. 23, 1987 [DE] Fed. Rep. of Germany ..... 3705741

[51] Int. Cl.[4] ..... B67D 5/52

[52] U.S. Cl. ..... 222/94; 222/135; 222/389

[58] Field of Search ..... 222/94–96, 222/135, 137, 145, 252, 255, 263, 325, 333, 386.5, 389, 395, 401; 418/215

[56] References Cited

U.S. PATENT DOCUMENTS

| | | | |
|---|---|---|---|
| 3,187,951 | 6/1965 | Hardman et al. | 222/135 X |
| 3,831,815 | 8/1974 | Glasgow | 222/94 |
| 3,871,553 | 3/1975 | Steinberg | 222/95 |
| 4,004,717 | 1/1977 | Wanke | 222/255 |
| 4,067,479 | 1/1978 | Moline | 222/94 |
| 4,386,717 | 6/1983 | Koob | 222/94 |
| 4,426,022 | 1/1984 | Lang et al. | 222/130 |
| 4,767,033 | 8/1988 | Gemperle | 222/383 |

FOREIGN PATENT DOCUMENTS

| | | | |
|---|---|---|---|
| 1286946 | 1/1969 | Fed. Rep. of Germany | 222/94 |
| 2644780 | 4/1978 | Fed. Rep. of Germany | 222/94 |

*Primary Examiner*—Michael S. Huppert
*Attorney, Agent, or Firm*—Toren, McGeady & Associates

[57] ABSTRACT

A device for dispensing metered quantities of flowable multi-component masses includes a housing with separate chambers, each containing a flexible bag with one component of the multi-component mass. Material is pressed out of the bags by a liquid propellant supplied from a reservoir in the housing to the chambers by gear wheel pumps located in a conduit connecting the reservoir to the chambers. The pumps are connected to a common drive so that the mixture ratio of the components is exactly maintained for any desired amount to be dispensed.

6 Claims, 1 Drawing Sheet

DISPENSING DEVICE FOR FLOWABLE MASSES

BACKGROUND OF THE INVENTION

The present invention is directed to a device for the metered dispensing of flowable multi-component masses by pressing flexible bags containing individual components of the mass by means of a propellant.

Multi-component masses are utlized increasingly in industry and in arts and crafts for bonding, filling, sealing and similar operations. To prevent a premature reaction of the components, individual components must be stored in separate containers until ready to be used.

In a known apparatus, each component is contained within a separate cylindrical cartridge containing a displaceable dispensing piston. Such apparatus is very expensive and results in high production costs. In addition, sealing problems can develop at the dispensing piston particularly when high pressures are used in the dispensing operation. If the piston is not absolutely tightly sealed, contamination of the apparatus for dispensing the material from the separate cartridges may develop.

Further, it is known to package the components in separate flexible bags for effecting sealing as well as lower costs. The material has been pressed out of the bags mechanically, such as by rollers or by a propellant or motive agent acting on the wall of the bag. In DE-AS No. 2 644 780, there is a known device where the bags are arranged in a common chamber and, thus, are exposed to the same pressure of the pressing means. Dispensing of the components can only occur at a specific constant mixture ratio if the viscosity of the components is approximately equal. In the use of multi-component masses, particularly in the construction industry, the viscosity of the individual components is quite different and, further, changes as a function of the ambient temperature. The achievement of a specific mixture ratio cannot be assured when such masses are used in the above device.

SUMMARY OF THE INVENTION

The primary object of the present invention is to provide a simple device for pressing components of a multi-component mass out of separate flexible bags in a specific mixture ratio.

In accordance with the present invention, each flexible bag is located in a separate chamber and the pressing agent or propellant is supplied through a metering arrangement.

By placing the bags in separate chambers, a reciprocal interaction is avoided, so that the required dispensing pressures can be established independently of one another as a function of the viscosity of the components. The metering of the components making up the mass to be dispensed is effected by means of a preferably liquid propellant resulting in a relatively simple construction of the dispensing device. The metering arrangement for the propellant does not requre any cleaning even when the device is not used for long periods, because the device moves the propellant back and forth between the chambers and the reservoir for the propellant.

Preferably, the metering arrangement is provided by pumps with a volumetric output. Piston pumps or eccentrc pumps can be used for this purpose. Further, the pumps can be actuated manually or by motor. It is particularly advantageous if gear wheel pumps are used.

Gear wheel pumps do not require any valves and can be operated satisfactorily in supplying and withdrawing the propellant from the chambers. Further, gear wheel pumps afford a compact construction.

To maintain a constant mixture ratio of the component for specific applications, the pumps for the individual components are coupled together. Coupling of the pumps can be effected by a direct connection of the pumps or by a common drive shaft. By interposing a speed change gear box or a variable gear box, the mixture ratio can also be changed. It is also possible to provide electronic regulation of the drive motors of the individual pumps.

After the bags are placed in the chambers, usually there is a certain residual free volume within the chamber which is filled with air at the commencement of the dispensing operation. Such an air cushion can interfere with the dispensing of the component, so that the preset mixture ratio cannot be obtained. To avoid such a problem, it is advantageous to equip the chambers with venting valves. The venting valves are operated at the outset of the dispensing operation until the propellant emerges from the venting valves. So-called automatic valves can also be used in place of manually operated venting valves. Such valves shut off automatically as soon as the propellant liquid enters the valves.

The various features of novelty which characterize the invention are pointed out with particularity in the claims annexed to and forming a part of this disclosure. For a better understanding of the invention, its operating advantages and specific objectives attained by its use, reference should be had to the drawings and descriptive matter in which there is illustrated and described a preferred embodiment of the invention.

DETAILED DESCRIPTION OF THE INVENTION

Figures 1, 2:
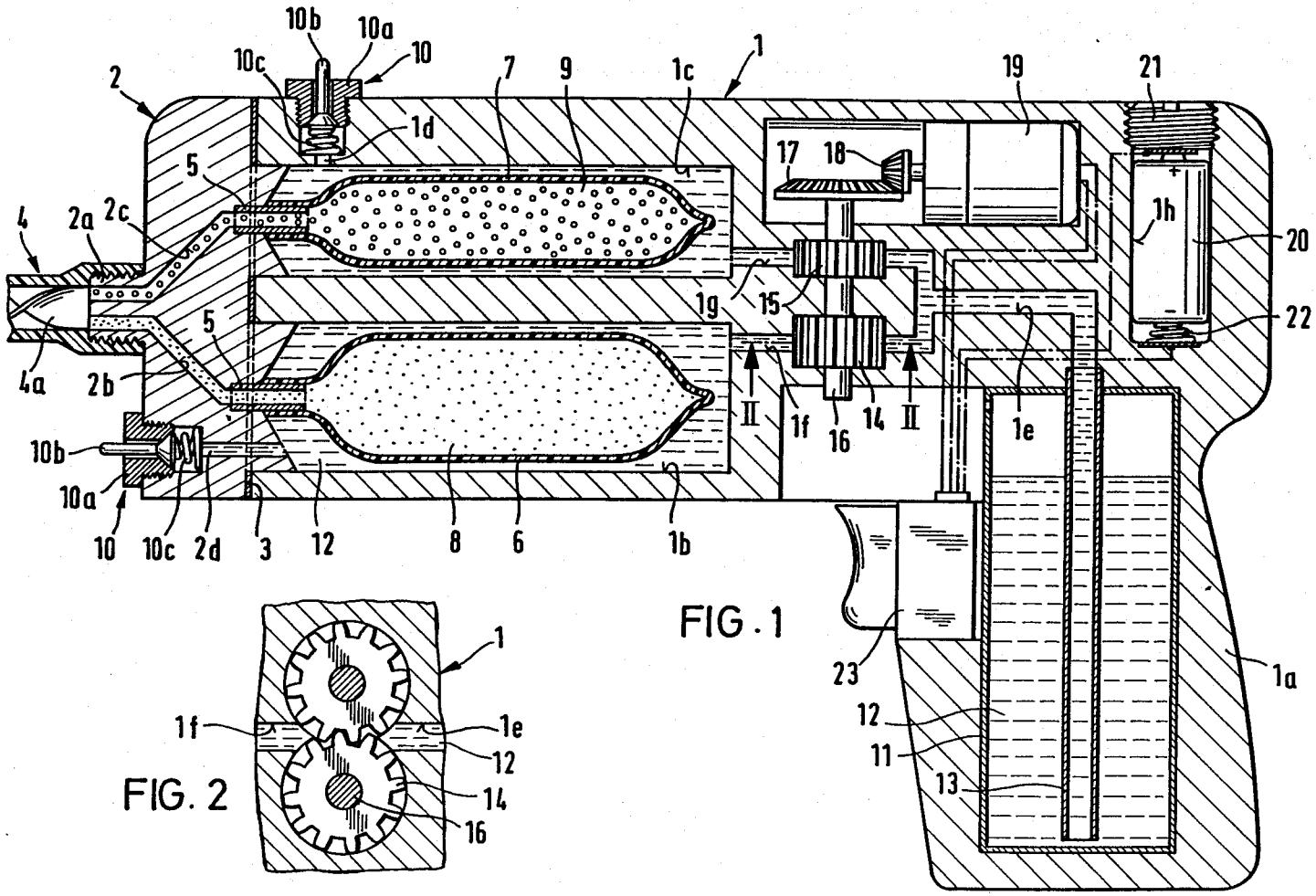
FIG. 1 is an elevational view mostly in cross section of a device embodying the present invention for the metered dispensing of multi-component masses.
FIG. 2 is a cross-sectional view taken along the line II—II in FIG. 1.

The device embodying the present invention and illustrated in FIG. 1 includes a handgun-shaped housing 1 with a cap part 2 located at the muzzle-like end of the housing. The housing has a handle 1a at one end projecting downwardly from the main part of the housing, as shown in FIG. 1. A seal 3 is positioned between the front end of the housing 1 and the cap part 2. The cap part has a threaded stub *2a* projecting from the front of the device, and a dispensing nozzle 4 is mounted on the stub. Mixing elements *4a* are located within the dispensing nozzle 4 for mixing the components making up the mass. Cap part 2 has a pair of channels *2b, 2c* extending from the threaded stub *2a* rearwardly to the interface with the housing 1. At the interface, connector nipples 5 extend from the ends of the channels *2b, 2c* into the leading end of the housing 1. Housing 1 forms two chambers *1b, 1c*, each receiving a bag 6, 7 holding a component 8, 9 of amulti-component mass. The two chambers *1b, 1c* are arranged generally parallel to one another and are closed at the leading end of the housing by the cap part 2. The bags 6, 7 do not completely fill the chambers *1b, 1c*. The leading end of the bags within the chambers are connected to the cap part 2 by the connector nipples 5 which fit into the leading ends of the bags. The housing 1 has a venting bore 1d connected to the chamber 1c and the cap part 2 has a venting bore 2d connected to the chamber 1b. Each venting bore 1d, 2d has a manually actuated venting valve 10 communicating between the inside of the chamber and the ambient atmosphere. Each venting valve 10 is formed of a valve body 10a, a tappet 10b and a pressure spring 10c biasing the tappet 10b against the valve body 10a for maintaining it in the closed position.

A reservoir 11 is located within the handle 1a and contains a liquid propellant 12, such as hydraulic oil. Propellant 12 flows out of the reservoir 11 through a suction line 13 and into a suction line 1e in the housing. The suction line le is divided into two parallel suction lines, each leading toward a different one of the chambers 1b, 1c. One gear wheel pump 14 is located in one suction line and another gear wheel pump 15 is located in the other suction line. The gear wheel pumps 14, 15 are driven by a common drive shaft 16 so that the two pumps are coupled together. The gear pump 14 supplies the propellant through an inlet line 1f into chamber 16 and gear pump 15 supplies the propellant through inlet line 1g into chamber 1c. Drive shaft 16 is connected to a bevel gear 17 within the housing 1 and the bevel gear meshes with a bevel pinion 18 mounted on the end of the drive shaft of a motor 19. As shown in FIG. 1, the motor is powered by a battery 20 located within a space 1h in the housing 1. A screw plug 21 located in the housng opens into the space 1h and holds the battery 20 against a contact spring 22. The electrical connection of the motor 19 with the battery 20 is effected through a switch 23 located in the handle 1a and over connecting means shown in dot-dahs lines within the housing. The motor 19 and the gear wheel pumps 14, 15 connected to it can be switched on and off by the switch 23 and the propellant can be drawn out of the reservoir 11 through the suction line 1e into the divided suction lines and then from the gear pumps through inlet lines 1f, 1g into the chambers 1b, 1c. As a result, the flow of the propellant 12 into the chambers presses the contents of the bags 6, 7 through the nippls 5 into the outlet lines or channels 2b, 2c. The flow of the two outlet lines 2b, 2c is separate through cap part 2 until the components flow into the dispensing nozzle 4. Within the nozzle 4, the components are mixed together by the mixing element 4a. At the beginning of the dispensing operation, any air within the chambers 1b, 1c is evacuated from the chambers through the venting valves 10. The presence of air cushions within the chambers 1b, 1c could otherwise interfere with the continuous dispensing of the components 8, 9. When the bags 6, 7 are completely emptied, the rotational direction of the motor 19 can be reversed by the switch 23 and the propellant can be conveyed from the chambers 1b, 1c back into the reservoir 11. When the chambers 1b, 1c have been completely emptied, the cap part 2 is removed and the empty bags 6, 7 are replaced by filled bags 6, 7.

In FIG. 2, the gear wheel pump 14 is shown with one of the gear wheels mounted on the drive shaft 16 and with the suction line le shown supplying the propellant to the gear wheel pump 14 and the inlet line 1f conveying the propellant into the chamber 1b.

For proper operation of the removal of the propellant 12 from the reservoir 11, a vent hole is provided in the upper end of the reservoir opening to the exterior of the housing.

While a specific embodiment of the invention has been shown and described in detail to illustrate the application of the inventive principles, it will be understood that the invention may be embodied otherwise without departing from such principles.

I claim:

1. Device for dispensing metered quantities of flowable multi-component masses, comprising means forming at least two separate closed chambers, a flexible bag containing a component of a multi-component mass positioned within each said chamber, a reservoir containing a fluid propellant, conduit means interconnecting said reservoir and said separate chambers, a device in communication with said conduit means for conveying the fluid propelant from the reservoir into the separate chambers for dispensing metered amounts of each of the components to an outlet where the components are mixed, said device for conveying the fluid propellant comprises pumps with a volumetric output, said conduit means comprises a separate conduit line for each of said chambers, and one said pump in each of said conduit lines for withdrawing fluid propellant from said reservoir and delivering the fluid propellant into said chambers, and said pumps in each of said conduit lines are coupled to one another.

2. Device, as set forth in claim 1, wherein each of said chambers has a venting valve.

3. Device, as set forth in claim 1, wherein each said pump in each of said conduit line is a gear wheel pump.

4. Device, as set forth in claim 3, wherein said means forming said chambers comprise a housing, said housing being open at one end with said chambers being open at the open end, a cap part engageable with said housing for closing said chambers, a dispensing nozzle mounted on said cap part, separate passageways extending through said cap part to said dispensing nozzle from said chambers for supplying the components located within said flexible bags in said chambers to said dispensing nozzle.

5. Device, as set forth in claim 4, wherein said housing has a handgun shape with a handle located at the opposite end of said housing from said cap part, said reservoir located at least in part within said handle, said conduit means extending from said reservoir through said housing to said chambers with a separate line connected to each of said chambers, one said gear wheel pump located in each of said separate lines, a common drive shaft couples said gear wheel pumps together, and means for driving said common drive shaft located within said housing.

6. Device, as set forth in claim 5, wherein each of said chambers has a venting valve comprising a bore extending between each of said chambers and the exterior of said device, a valve body secured in said bore, a tappet extending through said valve body and forming a closure for an outlet passage through said valve body, and spring means within said bore for maintaining said tappet against said valve body for closing off flow through the outlet passage in said valve body, and said tappet extending through said valve body to the exterior of said device so that said tappet can be manualy actuated.

* * * * *